United States Patent [19]

Wolz et al.

[11] 4,140,357

[45] Feb. 20, 1979

[54] ELECTRIC HINGE

[75] Inventors: Francis T. Wolz; Lawrence D. Butts; Raymond V. Kambic, all of Joliet, Ill.

[73] Assignee: Folger Adam Co., Division of Telkee, Inc., Joliet, Ill. ; by said Francis T. Wolz and Lawrence D. Butts

[21] Appl. No.: 865,323

[22] Filed: Dec. 28, 1977

[51] Int. Cl.[2] ..... H01R 39/00

[52] U.S. Cl. ..... 339/4; 49/167; 174/86; 200/61.7

[58] Field of Search ..... 200/61.7, 61.82, 61.81; 174/86; 49/167; 339/4

[56] References Cited

U.S. PATENT DOCUMENTS

| | | | |
|---|---|---|---|
| 3,838,234 | 9/1974 | Peterson | 200/61.7 |
| 3,860,312 | 1/1975 | Gordon, Jr. | 339/4 |

*Primary Examiner*—Roy Lake

*Assistant Examiner*—DeWalden W. Jones

*Attorney, Agent, or Firm*—Clarence A. O'Brien; Harvey B. Jacobson

[57] ABSTRACT

A hinge for use with a swinging door provided with an electric lock or other electrically operated device or component therein in which the hinge is provided with chases and hollow hinge barrels sheathing a tubular collar which also serves as a hinge pin and provides a continuous passageway through the hinge for electrical conductors in order to maintain a continuous circuit or circuits through the hinge regardless of the position of the door. Each hinge leaf includes a barrel integral therewith with the barrel and leaf being a one-piece casting. The barrels completely enclose the tubular collar which forms a hollow hinge pin and protects the electrical conductors from attack in the event the leaves and barrels are pried apart.

7 Claims, 5 Drawing Figures

ELECTRIC HINGE

BACKGROUND OF THE INVENTION

1. Field of the Invention

The present invention generally relates to door supporting hinges and more particularly an electric hinge having chases or passageways incorporated therein for receiving insulated electrical conductors so that such conductors may pass from the door jamb to the door to operate electric locks, monitor the position of the door, condition of the lock or to accomplish any other purpose in which electrical energy is required, with the hinge including a completely enclosed tubular collar defining a hollow hinge pin extending between and interconnecting the hinge barrels on each leaf of the hinge with the collar being completely enclosed and concealed, and protecting the wires from attack in the event the hinge leaves and barrels are pried apart.

2. Description of the Prior Art

Along with the development of electrically operated locks for releasably securing doors in closed position, it has been necessary to supply electrical energy to the locks. In addition, monitor circuits are provided to indicate the condition of certain components of the electric lock as well as the position of the door, so that such information can be made available at a remote location. The use of electric locks on security doors introduces the problem of attack on the electrical circuits by persons wishing to alter the condition of the electric lock or alter the signals provided by the monitor circuits. It, therefore, is desirable for the electrical conductors to not only be concealed, but also to be protected from attack. The provision of electrical circuits through the hinge is known. For example, U.S. Pat. No. 3,838,234, issued Sept. 24, 1974, discloses an arrangement for this purpose but in this construction, the hinge barrel is provided with slip ring and wiper contact assemblies for maintaining the circuit during pivotal movement of the hinge leaves. Other patents, such as U.S. Pat. No. 3,659,063, 3,715,537, and 3,803,375 disclose arrangements in which circuit completing and breaking contacts or switches are associated with the hinge leaves to either complete a circuit through the hinge or operate a switch in a circuit in response to pivotal movement of the leaves of the hinge. Previously known devices in which the electrical contacts, switches, or the like, are exposed to view are also subject to attack by persons desiring to render the contacts or switches inoperative or to modify the operation in a particular manner. Structures in which slip rings and wiper contacts are utilized are rather complicated and expensive to manufacture with such devices also being subject to wear and ineffectiveness of the relatively movable components, thereby requiring substantial maintenance and repair. Also, such devices are subject to attack when the hinge leaves and barrels are pried apart.

SUMMARY OF THE INVENTION

An object of the present invention is to provide a hinge for supporting a pivotal closure member, such as a swinging door in relation to a door jamb and incorporating a structure therein which facilitates reception and passage of one or more electrical conductors in the form of insulated electrical wires in a manner in which the wires are continuous and unbroken through the hinge and are maintained in a completely concealed relation and effectively protected from attack when the hinge leaves and barrels are pried apart.

Another object of the invention is to provide an electric hinge in accordance with the preceding object in which each hinge leaf and barrel are integral and cast with a chase or passageway in the surface thereof attached to the edge of the door or the door jamb with the hinge barrels including closed outer ends and being pivotally connected by a tubular collar telescoped into the inwardly facing and abutting open ends of the hinge barrels, thereby defining a hinge pin for the hinge with the collar being completely sheathed or enclosed by the hinge barrels in which the collar is cylindrical and relatively thin walled but constructed of high strength, wear resistant materials to not only effectively pivotally interconnect the hinge barrels but also provide a protected passageway for a multiplicity of insulated electrical wires longitudinally therethrough so that the electrical wires are maintained continuous and unbroken through the hinge barrels and the chases or passageways provided in the hinge leaves which are in communication with the interior of the hinge barrel on each leaf.

A further object of the invention is to provide an electric hinge having the exact same external appearance characteristics as a standard hinge such as used solely for the purpose of supporting the door with the electric hinge normally being provided at the vertical center position or generally in horizontal alignment with an electrically operated lock, or the like, to maintain the length of the electrical conductors or wires as short as possible and to reduce as much as possible the capability of pry-type tools being utilized to pry the hinge leaves or barrels apart, since such tools cannot be fulcrumed against the stationary door jamb at the center as compared with the top and bottom of the door opening.

Still another object of the invention is to provide a hinge in accordance with the preceding objects in which the ends of the hinge barrels exposed to the top and bottom of the hinge are completely closed, thus concealing the tubular collar which serves as the hinge pin with the tubular collar being constructed of stainless steel having a length dimension less than the total length of the hollow interior of the hinge barrels and being telescoped equally into the hinge barrels with the collar being press-fitted and thus rigidly affixed to one of the hinge barrels thereby providing passageway for a plurality of insulated electrical wires which have been constructed to provide long life through a plurality of twisting, flexing or bending operations as would occur during a large number of cycles of pivotal movement of the door in relation to the door jamb, thereby rendering the hinge quite effective for use in combination with various types of hollow metal or wood doors, such as in correctional institutions, mental institutions, hospitals, or other institutions in which the doors may be provided with an electric lock and are subject to extensive use.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
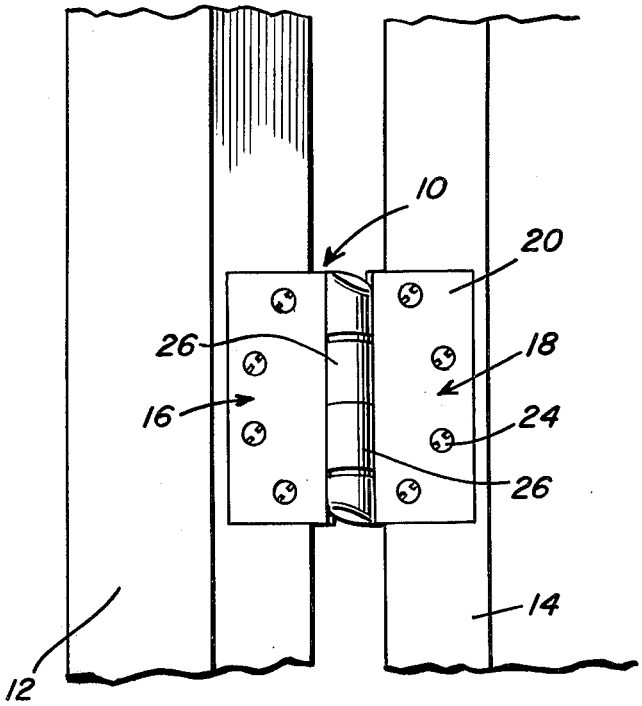
FIG. 1 is a perspective view of the electrical hinge of the present invention installed between a door and door jamb, preferably adjacent the vertical center thereof.
Figure 3:
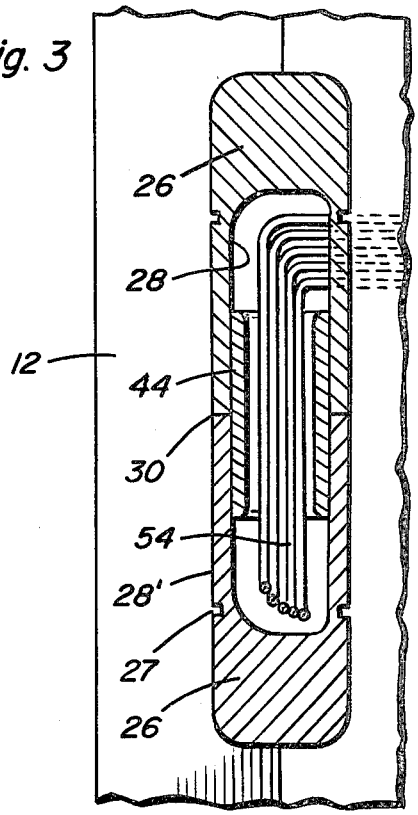
FIG. 3 is a longitudinal, vertical sectional view taken substantially upon a plane passing along section line 3—3 of FIG. 2 illustrating further structural details of the hinge.

Referring now specifically to the drawings, the electric hinge of the present invention is generally designated by reference numeral 10 and is mounted between a stationary door jamb 12 and the edge of a door 14 in a conventional manner, such as by mortising the hinge leaves into the supporting surface. The electric hinge 10 is used when the door 14 is provided with an electric lock (not shown) or other electrically operated devices or electrically operated monitoring devices, and the like, with the hinge being capable of use with metal or wood doors which are hollow or provided with passageways for electrical conductors with the electric hinge 10 providing means for enabling the electrical conductors to be continuous from the jamb 12 to the door 14.

Figure 2:
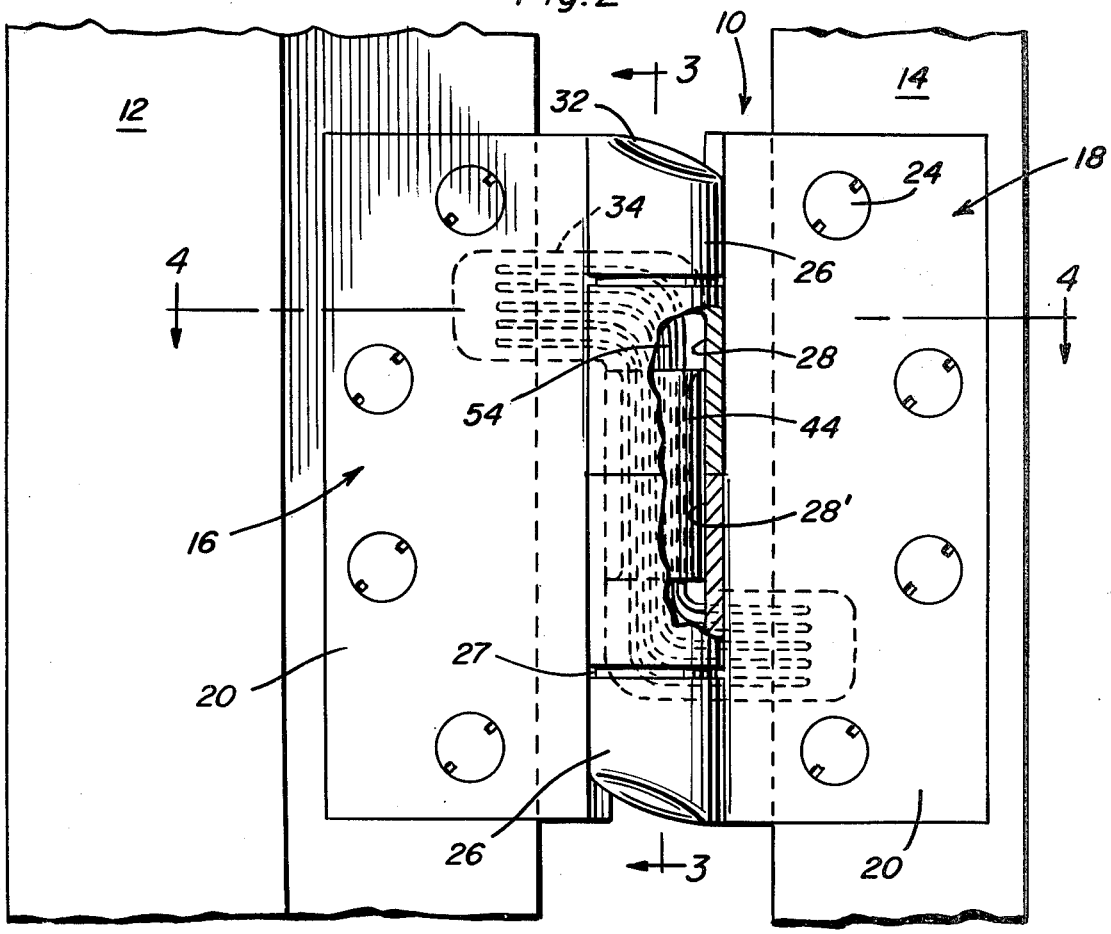
FIG. 2 is an enlarged, elevational view of the hinge with portions of the hinge barrels broken away illustrating the position of the collar therein and the relationship of the electrical conductors to the hinge.
Figure 4:
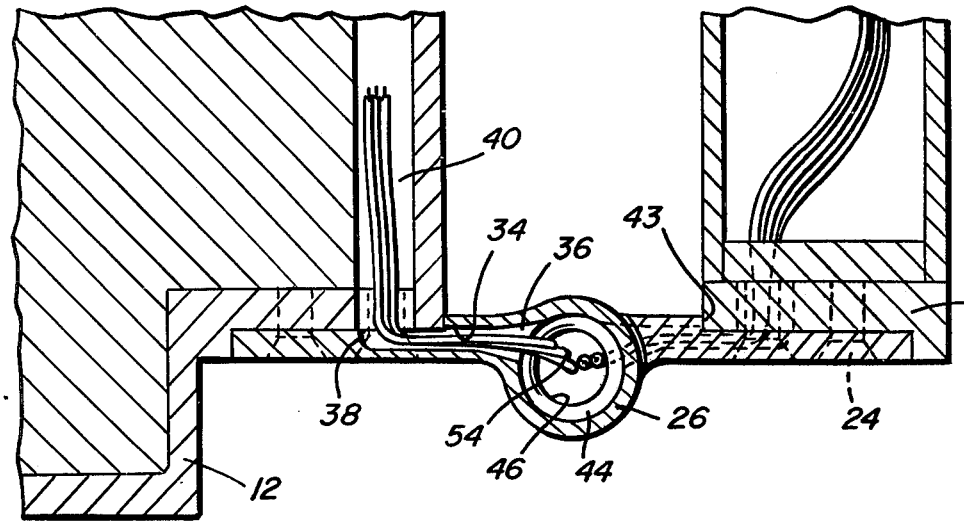
FIG. 4 is a transverse, sectional view taken substantially upon a plane passing along section line 4—4 of FIG. 2 illustrating further structural details of the hinge.
Figure 5:
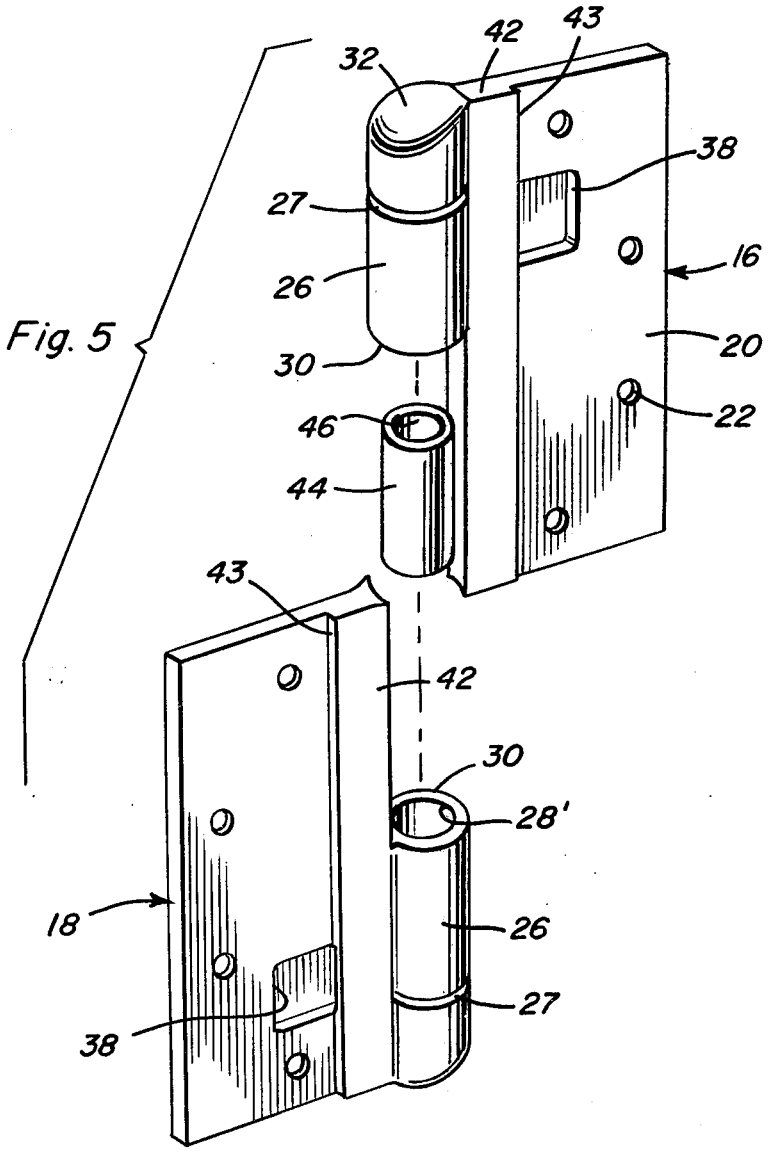
FIG. 5 is an exploded, group perspective view illustrating the components of the hinge prior to assembly of the collar with respect to the hinge barrels.

The hinge 10 includes two leaves 16 and 18 with the leaf 16 being secured to the door jamb 12 and the leaf 18 being secured to the door 14. The leaf 16 includes a plate 20 of rectangular configuration which has the major dimension disposed vertically and a plurality of apertures 22 are provided through the plate 20 with the apertures 22 having their outer ends countersunk for receiving correspondingly shaped heads of security screws 24, such as flat head spanner type screws. One edge of the plate 20 is provided with an integral hinge barrel 26 having a length generally equal to one-half of the length of the plate 20 and provided with a hollow, cylindrical interior 28 extending from the inner end 30 thereof but terminating in spaced relation to the outer end 32 which is completely solid and closed and which is also rounded and slightly inclined from its juncture with the end edge of the plate 20 as illustrated in FIG. 2. The plate 20 is provided with a chase 34 in its inner surface which is disposed inwardly from the end edge of the plate and communicates with and forms a continuation of the hollow interior 28 of the barrel 26, with the inner end 36 of the chase 34 where it communicates with the interior 28 being slightly outwardly flared and the outer end of the chase 34 terminating in a generally square or rectangular recess 38 opening to the inner face of the plate 20 as illustrated in FIG. 5 with the recess 38 being in alignment with and communication with a passageway or hollow interior 40 in the door jamb 12. The inner portion of the plate 20 along its junctures with the barrel 26 is slightly thicker as indicated by numeral 42 and includes an offset shoulder 43 thereon engaging the corner of the door jamb 12 as illustrated in FIG. 4 in order to securely and rigidly affix the hinge leaf 16 to the door jamb.

The hinge leaf 18 is identical in construction to the hinge leaf 16 and the same reference numerals are applied to the structure thereof with the exception that the hollow interior 28′ on the hinge barrel 26 forming part of the leaf 18 is slightly smaller in diameter as compared with the interior 28 of the hinge barrel 26 on the hinge leaf 16 as illustrated in FIG. 2 and, of course, the recess 38 on the hinge leaf 18 is associated with a passageway 42′ formed in the door 14.

To provide a hinge pin pivotally interconnecting the hinge barrels 26, a tubular collar 44 is provided which is telescoped into the tubular interiors 28 and 28′ of the hinge barrels 26. The collar 44 is cylindrical in construction and includes a cylindrical interior 46 which aligns with and forms a continuation of the interiors 28 and 28′ as well as the chases 34. One end portion of the collar 44 is inserted into the slightly smaller interior 28′ in a press-fit relationship so that the collar 44 becomes rigid with and affixed to the barrel 26 on the leaf 18, as illustrated in FIG. 2, with the other end portion of collar 44 being received rotatably within the interior 28 of the hinge barrel 26 on the leaf 16.

A plurality of insulated electrical wires 54 extend through the collar 44 and the adjacent portions of the interiors 28 and 28′ and through the chases 34 so that the electrical wires are continuous from the hollow door frame 12 to the hollow door 14. These wires are constructed of materials which enable them to be repeatedly flexed, twisted, bent for a long period of time or for a large number of cycles so that the electrical hinge may be installed in various types of doors, such as for institutional use having high incidents of door openings and closings. It has been found that materials complying with ASTM-B33 are satisfactory for this purpose.

The barrels 26 completely sheath the collar 44 which is constructed of extremely hard and durable stainless steel, or the like, thereby effectively protecting the wires 54 from tampering or attack by persons interested in interrupting the electrical circuit or otherwise modifying the structure controlled or monitored through the electric wires. The hinge leaves are cast with the chases or ports which receive the wires being cast into the leaves. Various sizes of electrical wires may be utilized, such as five wires of 18 gauge with the collar 44 being thin walled and enabling larger diameter wires to effectively pass therethrough. The hinge barrels 26 are each provided with an external groove 27 which renders the hinge more nearly simulative of a conventional hinge, that is, one that does not include a tubular hinge pin so that the fact that the electric hinge 10 includes electrical wires will be concealed.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A hinge for pivotally connecting a pair of relatively swingable members and enabling passage of continuous electrical conductor means from one member to the other, said hinge comprising a pair of hinge leaves with each leaf including an attaching plate and a hinge barrel along a portion of one edge thereof, each leaf including a chase communicating the interior of the hinge barrel with the face of the plate engaged with the member to which it is attached, and a tubular collar bridging aligned hinge barrels and forming a hinge pin therefor with the ends of the collar terminating inwardly of said chases thereby providing a continuous passageway for the electrical conductor means.

2. The structure as defined in claim 1 wherein said collar is rigidly affixed to one of said hinge barrels and is of thin-walled hard material to protect the electrical conductor means even if the leaves and barrels are pried apart.

3. The structure as defined in claim 1 wherein said electrical conductor means includes a plurality of insulated electric wires having high resistance to repetitive twisting, flexing and bending.

4. The structure as defined in claim 1 wherein said collar has one end portion being press-fitted into the barrel and thereby rigidly affixed thereto.

5. The structure as defined in claim 1 wherein said hinge barrels have closed outer ends thereby concealing said collar and said electrical conductor means.

6. The structure as defined in claim 1 wherein one of said members is a door jamb and the other is a door and the electrical conductor means includes a plurality of electric wires to enable operation of an electric door lock, monitoring devices, and the like.

7. The structure as defined in claim 4 wherein said hinge barrels have closed outer ends thereby concealing said collar and said electrical conductor means and one of said members is a door jamb and the other is a door and the electrical conductor means includes a plurality of electric wires to enable operation of an electric door lock, monitoring devices, and the like.

* * * * *